US007847747B2

(12) United States Patent
Apostolos

(10) Patent No.: US 7,847,747 B2
(45) Date of Patent: Dec. 7, 2010

(54) ORIENTATION-INDEPENDENT ANTENNA (ORIAN) WITH SHORTS

(75) Inventor: John T. Apostolos, Lyndborough, NH (US)

(73) Assignee: BAE Systems Information and Electronic Systems Intergration Inc., Nashua, NH (US)

( * ) Notice: Subject to any disclaimer, the term of this patent is extended or adjusted under 35 U.S.C. 154(b) by 287 days.

(21) Appl. No.: 12/152,415

(22) Filed: May 14, 2008

(65) Prior Publication Data

US 2009/0096691 A1 Apr. 16, 2009

Related U.S. Application Data

(60) Provisional application No. 60/937,026, filed on Jun. 25, 2007.

(51) Int. Cl.
*H01Q 11/12* (2006.01)

(52) U.S. Cl. ..... 343/742; 343/741

(58) Field of Classification Search ..... 343/742, 343/867, 842, 726, 727, 728, 741
See application file for complete search history.

(56) References Cited

U.S. PATENT DOCUMENTS 6,069,564 A * 5/2000 Hatano et al. ..... 340/572.7
6,373,446 B2 * 4/2002 Apostolos ..... 343/797
7,505,009 B2 * 3/2009 Parsche et al. ..... 343/742
7,619,579 B2 * 11/2009 Rahamim et al. ..... 343/793

FOREIGN PATENT DOCUMENTS

GB 2380325 A * 4/2003

* cited by examiner

*Primary Examiner*—Jacob Y Choi
*Assistant Examiner*—Kyana R Robinson
(74) *Attorney, Agent, or Firm*—Robert K. Tendler; Daniel J. Long

(57) ABSTRACT

An orientation-independent antenna that presents a circular polarization characteristic to incoming waves such that these waves are detected regardless or polarization and angle of arrival is provided with shorts across elements thereof that provide for crossed vertical loops and a horizontal loop to lower the VSWR at the lower frequencies of the antenna. The antenna includes crossed vertical loops and a horizontal loop, with the loops being phased to provide the circular polarization characteristic. In one embodiment, the antenna includes a number of elements on the faces of a cube, or the elements are positioned on the surface of a sphere. In another embodiment, the antenna is given both a right hand circular polarization characteristic and a left hand circular polarization characteristic in two different channels to provide for double the data throughput.

14 Claims, 13 Drawing Sheets

| Side | 1 - 2 | 3 - 4 |
|---|---|---|
| 1 | 1 | -i |
| 2 | i | -1 |
| 3 | -1 | i |
| 4 | -i | 1 |
| 5 | -i | -1 |
| 6 | i | 1 |

| | |
|---|---|
| i | 90° |
| -i | -90° |
| 1 | 0° |
| -1 | 180° |

$i = \sqrt{-1}$

ORIENTATION-INDEPENDENT ANTENNA (ORIAN) WITH SHORTS

CROSS REFERENCE TO RELATED APPLICATION

This Application claims rights under 35 USC §119(e) from U.S. application Ser. No. 60/937,026 filed Jun. 25, 2007, the contents of which are incorporated herein by reference.

STATEMENT OF GOVERNMENT INTEREST

This related application claims the only feature of this invention which was made with United States Government support under Contract No. W56 HZV-05-C-0724 awarded by the U.S. Army which comprises the shorts shown in FIG. 16. The other features of the invention which are claimed in a co-pending companion application were not made under a United States Government contract.

FIELD OF THE INVENTION

This invention relates to an orientation-independent antenna which presents a circular polarization characteristic to incoming waves such that these waves are detected regardless of polarization and angle of arrival, and more particularly to the use of shorts to decrease the VSWR of the antenna at the lower frequencies thereof, thus to improve its bandwidth.

BACKGROUND OF THE INVENTION

Especially with regard to the control of robotic vehicles such as are used in war theatres and the like, it is important to be able to robustly communicate with the robotic vehicle from a base station. Presently, satellite communication systems (Satcom) are used where power levels are low and often times are not useful in communicating with terrestrial vehicles, especially those having antenna orientations that are not predictable.

For instance, as a robotic vehicle moves about terrain or for instance within a building, signals arrive at the antenna utilized by the robotic vehicle with a variety of different polarizations and directions.

If for instance the antenna utilized by the robotic vehicle is vertically polarized, then it will be insensitive to incoming signals having a horizontal polarization, and these signals, especially if they are weak, will not be detected. Likewise, if one utilized a horizontally polarized antenna, it would be insensitive to signals coming in with a vertical polarization. Of course, signals that are elliptically polarized which have components in both the vertical and horizontal directions would be non-optimally received with an antenna whose polarization did not match that of the incoming wave.

It would, therefore, be desirable to provide an antenna having a characteristic that is independent of the direction of arrival and polarization of an incoming wave. Such antennas are those exhibiting circular polarization as there will be no direction that results in polarization cancellations.

More particularly, if one were utilizing a vertical dipole on a robotic vehicle, one would have reasonable 360 degree coverage, but only for vertically polarized signals. The vertical dipole would therefore be relatively insensitive to horizontally polarized signals. In short, the dipole would not be sensitive to anything straight up.

To make matters somewhat more problematic, many antennas that are mounted on robotic vehicles have masts that are purposely flexible so that if the antenna hits an object, it will bend and not trap the antenna or stop the robot. The antenna with a flexible mast has its vertical or horizontal orientation direction altered by the flexibility of the mast which means that reliable communications cannot be established if the polarization direction of the antenna is not exactly aligned with that of the incoming signal.

In short, with a robotic vehicle as it moves through the environment, the antenna may tilt at various angles and therefore compromise communications with a base station. Further, when robotic vehicles maneuver through a building, signals can come in from various different directions due to multi-path problems. Since buildings even further attenuate satellite signals, optimum antenna orientation is a requirement if one is using anything other than a circularly polarized antenna.

Moreover, on robotic vehicles there is a requirement for miniaturization. It is not possible in most instances to provide elongated whips or antennas that are large with respect to the vehicle because of the terrain through which they operate, or because of the buildings in which they move. It is therefore important to be able to provide a miniature wide band antenna which has a circular polarization in all directions.

As described in a co-pending application entitled Orientation-Independent Antenna (ORIAN) by John T. Apostolos assigned to the assignee hereof, incorporated herein by reference and filed on even date herewith, while satisfactory performance over the majority of the bandwidth of this antenna has been achieved, lowering the VSWR, especially at the lower frequencies has been a problem. For instance, while in one embodiment of the orientation-independent circularly polarized antenna less than 2.5:1 VSWR is achievable between 245 MHz and 450 MHz, the VSWR of the antenna exceeds 2.5:1 between 225 MHz and 245 MHz. Note that at these lower frequencies a transmitter may throttle down in the face of high VSWR and may even stop transmitting, thus limiting the useful bandwidth of the antenna.

SUMMARY OF INVENTION

An orientation-independent circularly polarized antenna that uses crossed vertical loops and a horizontal loop is provided with an increased bandwidth by providing shorts between adjacent elements. When a cube is provided with triangular shaped elements, 4 each to a side of the cube, shorts between the bases of adjacent triangular shaped elements on adjacent vertical faces of the cube provide for an extension of bandwidth at the low end of the antenna's operating range. In one embodiment for an 8 inch cube, shorts down 0.95 from a top corner of the cube result in less than a 2.5:1 VSWR across the entire bandwidth of the antenna. For a Satcom antenna, this means acceptable operation between 225 MHz and 245 MHz in an antenna that has a frequency range from 225 MHz to 450 MHz. Thus low frequency operation is not precluded. The type of antenna for which the subject shorts are effective is now described.

In order to provide an antenna which has a circularly polarized characteristic at all directions, a pair of crossed vertical loops at 90 degrees to each other are driven in quadrature or at a 90 degree phase difference so that one has pure circular polarization at the zenith and pure vertical polarization at the horizon. As one progresses from the zenith to the horizon, the circular polarization degrades. Moreover, when using square loops for the vertical loops, a better approximation of circular polarization can be obtained by driving the four loop segments at 0°, 90°, 180° and 270° to provide for progressive phase excitation of the loops.

By inserting a horizontal loop at 90 degrees to both of the vertical loops and by also phasing the horizontal loop segments at 0°, 90°, 180° and 270°, it has been found that one obtains a circular polarization over an entire hemisphere and down to 45 degrees below the horizon. This is because when the vertical crossed loops are fed in quadrature, there is good circular polarization at the zenith, i.e. 90 degrees elevation. The axial ratio degrades as the elevation angle decreases until at 0 deg elevation there is only vertical polarization. The missing horizontal polarization at 0 deg is filled in by the horizontal loop. Note that the horizontal loop legs are progressively fed in 90 degree increments. The reason for this type of feed is that the vertically polarized wave from the vertical crossed loops has a progressive phase as a function of azimuth. The horizontal loop must have a progressive phase that matches the progressive phase of the wave from the vertical crossed loops. Furthermore, the phase of the horizontal loop must be offset 90 degrees from that of the vertical crossed loops.

In one embodiment, this triple loop orientation-independent antenna is implemented utilizing pairs of bowties on the six faces of a cube, with the pairs of bowties being implemented as triangular shaped conductive elements.

The cubic implementation of the three crossed loops provides an orientation independent antenna in which the field from this antenna is circularly polarized at all angles of arrival within a hemisphere.

Thus, at any position on a hemisphere surrounding the antenna one has circular polarization with magnitudes or amplitudes that are equal regardless of the point in space at which a signal comes in.

This permits robust receipt of signals regardless of angle of arrival and regardless of how the signals are either originally polarized or have their polarization altered before they arrive at the antenna.

Note, due to the volumetric nature of the antenna, the antenna exhibits wideband operation.

In one embodiment, the miniature antenna is provided by having triangular shaped metallic elements on a cube so as to form four opposed triangular elements on each side of the cube.

It will be appreciated that given a face of the cube and appropriate phasing of a pair of triangular shaped elements for one loop, one can achieve circular polarization in a direction normal to the face of the cube, both in the forward and rearward directions. This is accomplished by driving the two orthogonal sets of opposed triangular elements on the given face to yield circular polarization normal to the face of the cube.

Note that one has either a vertical polarization or a horizontal polarization out the edge of this face.

By using the various faces of the cube and forming the horizontal loop with four legs so that the legs of the loop are driven at 0°, 90°, 180° and 270° offset by 90° from the vertical loops, one can fill in the circular polarization out the edge of the face. For instance, for a cube side perpendicular to the face of the cube discussed above, its circular polarization directions being normal to this face are also normal to the circular polarization directions of the first face. This provides a full 360 degrees of circular polarization in the horizontal phase.

Likewise, the top face of the cube being perpendicular to the front face provides circular polarization in the vertical direction. This, when combined with the circular polarization in the horizontal direction now achieves circular polarization in a full 180° degree arc so that the combined faces provide circular polarization throughout a hemisphere in which the cubical antenna resides at its center. The subject antenna does provide better than hemispherical coverage in that its coverage extends downwardly by about 45 degrees.

More particularly, in one illustrative embodiment, the loops are provided by the triangular shaped elements on various faces of a cube with their apecies pointing inwardly to a point at the center of the face of the cube. In one embodiment, one pair of the crossed vertical loops is provided by sides 1, 5, 3 and 6 and triangular elements 3-4 on each face. The orthogonal vertical loop is comprised of sides 2, 5, 4 and 6 and elements 1-2 on each face.

In order to provide for the feeding of the crossed pair of loops, the 3-4 elements on sides 1, 5, 3 and 6 are fed progressively at 90° increments, with the 1-2 elements on sides 2, 5, 4 and 6 being driven at 90° with respect to the first loop. Additionally, each of the legs of each vertical loop are excited at 0°, 90°, 180° and 270°. The horizontal loop is driven by driving the 1-2 elements on vertical sides 1, 2, 3 and 4 progressively at 0°, 90°, 180° and 270°, offset 90° from the vertical loops.

While the phasing of the various legs of the various loops might require different phasing boxes for each of the loops, it has been found that the appropriate phasing of each of the legs of each of the loops can be accomplished utilizing a specialized feed network utilizing 6 hybrids. By feeding selected pairs of triangular elements on each side of the cube utilizing these 6 hybrids, one can simultaneously provide the appropriate phasing for each of the legs of each of the three loops.

In one embodiment, in order to provide feeds for the triangular shaped elements on the various faces of the cube, a number of combiners and/or hybrids are used. The combiners/hybrids establish the appropriate phase relationships. The first combiner functions as a summer to take the antenna feed and divide it into a feed that is associated with one corner of the cube which corresponds to the feeding of one of the aforementioned crossed loops.

The combiner/summer also splits off a signal which feeds a diametrically opposite corner of the cube to form the feed for the second of the crossed loops.

In an embodiment in which the combiners are not housed within the cube, for the crossed loop associated with one corner of the cube, a combiner splits the incoming signal and passes it to three separate hybrids, with each of the separate hybrids driving a set of coaxial feeds having their outer braids bonded to respective triangular elements as the coax extends towards an apex of an associated triangular element.

Each of the adjacent sections, for instance 1 and 4, on for instance sides 1, 2 and 5 of the cube are fed in this phased manner.

The result of the phased drive of sections 1 and 4 on sides 1, 2 and 5 of the cube are pairs of crossed loops, with one loop formed at sides 1, 5 and 3, and with the orthogonal loop formed at sides 2, 5 and 4. When driven appropriately, the result is the aforementioned circular polarization characteristic of the antenna that is independent of angle of arrival.

In one embodiment, the sides are connected to each other with matching and balancing impedances, Z. Note that the cube is centered in a spherical coordinate system in which the impedances are parallel combinations of capacitance and meanderlines.

With appropriate excitation the field associated with the cubic antenna in the upper hemisphere is close to being proportional to $$(\Phi - i\theta)\exp(i\Phi + i\theta) \qquad \text{Eq. 1}$$

where $\Phi$ and $\theta$ are the spherical coordinate basis vectors.

From this equation it can be seen that an observer sees a circularly polarized wave from any vantage point in the hemisphere.

Note that a small error associated with the θ component is present since the fields associated with that direction deviate from sinusoidal. The maximum deviation from 1 of the axial ratio is 0.8. If a sphere is used instead of a cube, then the worst case axial ratio is 0.95.

For an internally fed antenna, in one embodiment each side of the cube is fed with two ferrite coaxial transmission lines. For each vertical loop this leads to four pairs of coaxial cables converging at the center of the cube to form a beam former. All four excitation pairs are driven at 0° or 90° depending on which vertical loop is driven. The four pairs are combined in an eight way summer so that the two vertical loops can be driven albeit with a 90° phase shift provided by hybrids. The hybrids can be made up of wide band surface mounted components confined to a metal enclosure at the center of the cube, with equipment embedded in such a volumetric-based antenna not compromising performance. Note that the input ferrite loaded coax feeding the beam former can enter the antenna via one of the corners.

In an alternative embodiment, it is possible to feed the antenna without penetrating the interior. This type of feed is useful when the antenna interior is used as a space for other parts of the system and where the transmitter or receiver to be connected to the antenna is external to the antenna.

Note that in this embodiment pairs of coaxial lines feed selected sides of the vertical loops. The outer conductor of each coaxial line is bonded directly to the associated triangular element. The inner coax conductors cross over at the end of the coax to feed the adjacent triangular elements at the gaps between the feed vertices, with the feed forming a so-called infinite balun. The three pairs of coax converge to the nearest corner of the cubical antenna. At this corner ferrite loading is applied to the coaxial lines as the lines leave the antenna surface.

Note there is a complimentary set of three pairs of coaxial lines on the opposite side of the antenna. Sides 4, 3 and 6 are fed by these complimentary pairs. The lines converge at the corner diagonally situated with respect to the nearest corner. The two sets of three pairs of lines are brought together and coupled into a beam former.

The subject antenna can be fed for either right or left hand circular polarization. For optimal operation both polarizations can be monitored simultaneously to effect polarization diversity. This can provide double the data throughput.

The above describes the construction and phasing of an orientation-independent circularly polarized antenna. To lower the VSWR in the lower frequency range, shorts are provided to provide synergistic coupling between the elements, thus to lower the VSWR at the lower antenna frequencies.

In summary, an orientation-independent antenna presenting a circular polarization characteristic and having both crossed vertical loops and a horizontal loop is provided with improved bandwidth by the use of shorts between adjacent antenna elements to lower the VSWR of the antenna, especially at the lower frequency range of the antenna. In one embodiment the antenna elements are on the vertical faces of a cube.

BRIEF DESCRIPTION OF THE DRAWINGS

These and other features of the subject invention will be better understood in connection with a Detailed Description in conjunction with drawings, of which.

DETAILED DESCRIPTION

Prior to describing the improved performance afforded by the subject shorts, the basic orientation-independent antenna with circular polarization is now described.

Figure 1:
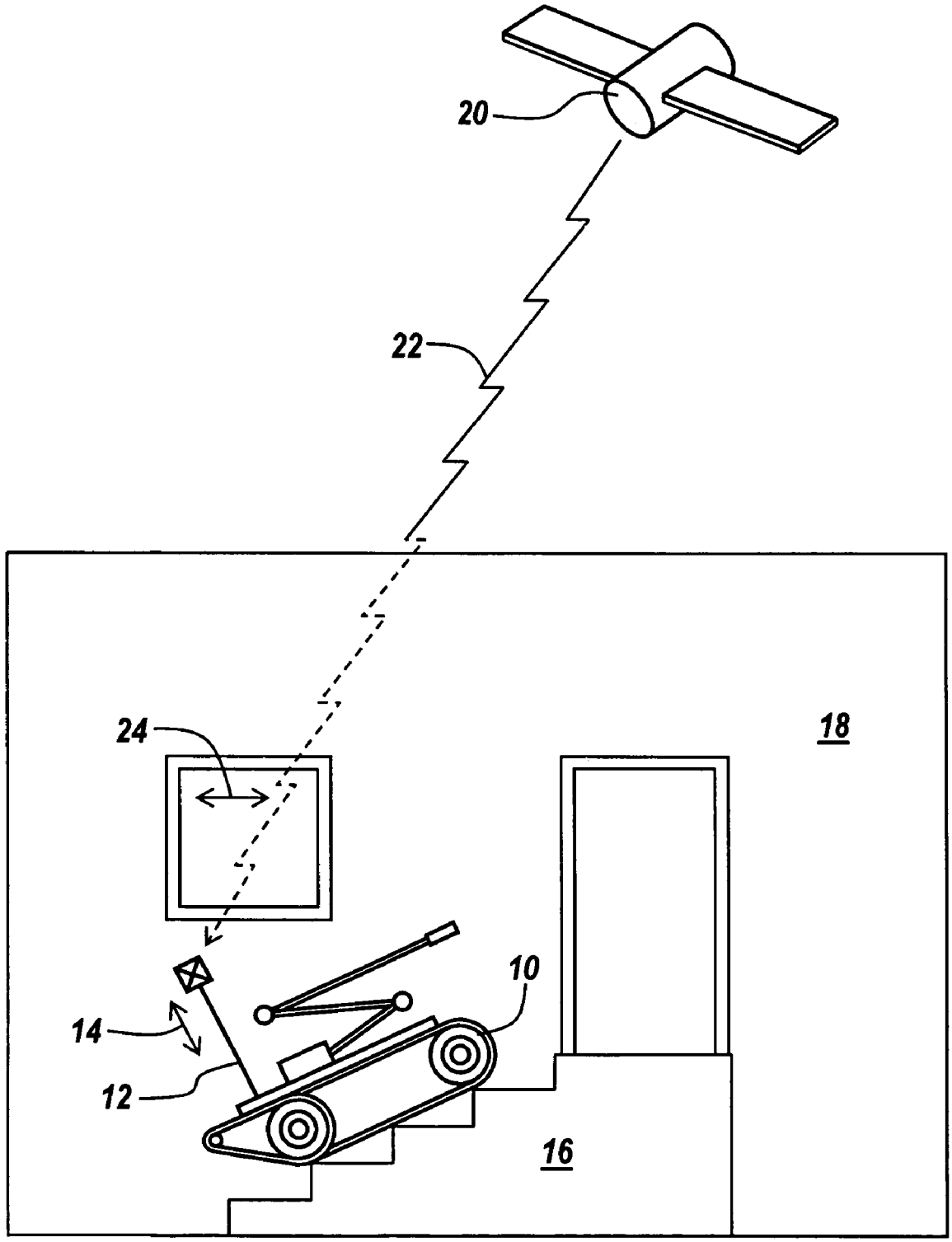
FIG. 1 is a diagrammatic illustration of a robot negotiating a set of stairs within a building, illustrating that generated signals reaching the antenna for the robot may arrive at a polarity that does not match the polarization of the antenna used by the robot, thereby precluding robust communications with the robot.

Referring to FIG. 1, the importance of having an orientation independent antenna is illustrated. Here, a robot 10 carries an antenna 12 which has an antenna polarization 14 characteristic of a whip antenna. As can be seen, the robot is traversing stairs 16 within a building 18 having walls which in general attenuate signals, for instance from a satellite 20, as the signal 22 goes through wall 18 and arrives at antenna 12.

As illustrated, the transmitted signal polarization is illustrated by a double ended arrow 24 which as can be seen does not line up with double ended arrow 14 corresponding to the polarization of the whip antenna. This means that the signals from the satellite, which may not be very powerful and which are further attenuated through the walls of the building, may not be robustly received if there is a mismatch in the polarization directions of the incoming wave and the antenna on the robot. In point of fact, it is possible that these signals could be cross polarized and therefore result in no energy being received by the transceiver within the robot.

Figure 2:
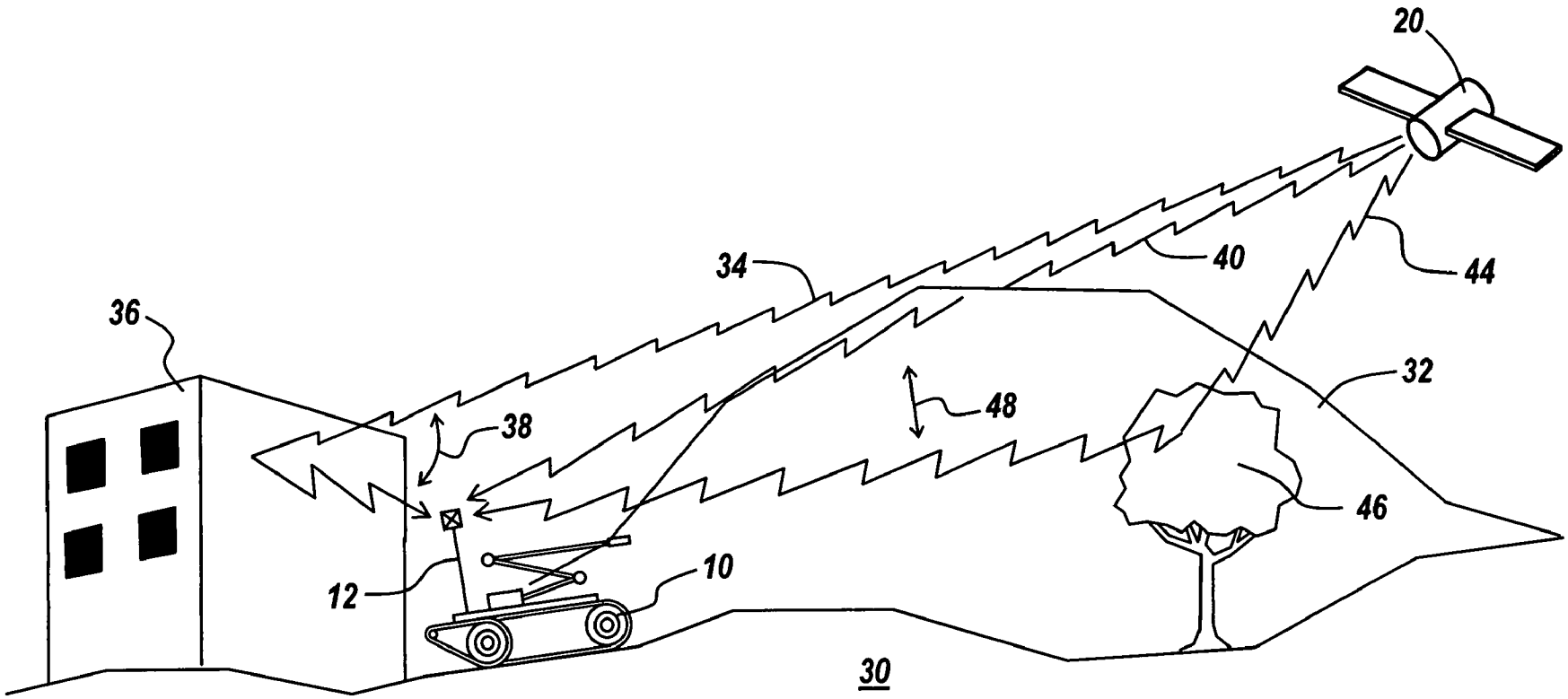
FIG. 2 is a diagrammatic illustration of the robot of FIG. 1 traversing terrain which reflects signals for instance from a satellite to the antenna of the robot in which the signals from the satellite may arrive at polarization orientations different than that of the antenna carried by the robot, or may be received by the antenna of the robot after having been reflected and the polarization orientation changed such that the signals from the satellite may be degraded due to multiple angles of arrival and reflections.

Referring to FIG. 2, robot 10 is shown traversing terrain 30 which has a hill 32 that may block signals from satellite 20. Moreover, the signal 34 from robot 20 may be reflected by building 36 and may be received at antenna 12 with a polarization direction altered as illustrated at 38.

Signals from satellite 20 come direct from the satellite as illustrated at 40 but may be attenuated as they pass through mound or hill 32 such that they arrive at antenna 12 with an unknown polarization direction and somewhat attenuated. Signals 44 from satellite 20 may be reflected by foliage 46 and redirected towards antenna 12 again with a polarization direction 48 that may not match the polarization of antenna 12.

What this shows is that in order for the robust receipt of signals, as weak as they may be, it is important that the antenna be able to respond to whatever is the polarization direction of the incoming signal.

It is part of the subject invention that the antenna utilized on the robot has a circular polarization characteristic such that it is insensitive to the polarization direction of incoming waves.

While the subject antenna will be described in connection with robots, other applications or orientation-independent antenna are within the scope of this invention. For instance, the use on ships avoids the use of whip antennas which sometimes interferes with aircraft.

Figure 3:
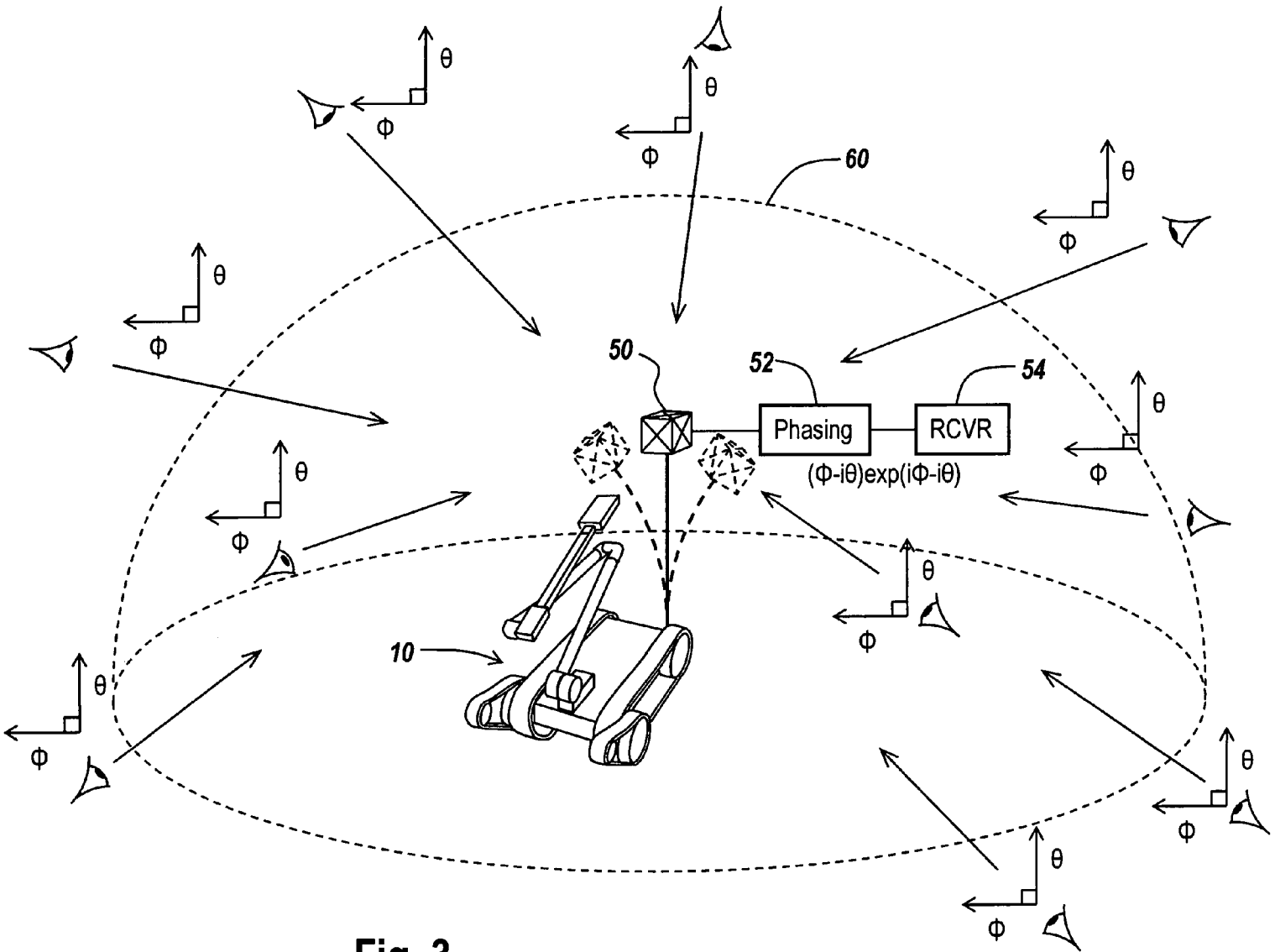
FIG. 3 is a diagrammatic illustration of the subject orientation-independent antenna mounted to a robot, with the antenna having a circular polarization characteristic within a hemisphere centered on the antenna such that the antenna response is independent of the polarization of the incoming signal.

As can be seen in FIG. 3, robot 10 is provided with the subject antenna 50 which is in the form of a cube. Not only is the cube small but its volumetric characteristics make it a wide band width antenna as well.

The antenna elements of the cube, which will be described hereinafter as being triangular, are phased by phasing module 52 such that as far as receiver 54 is concerned, the signals arriving at antenna 50 will be received regardless of their polarization. This is because for antennas that are given a circular polarization there will be no angle at which a polarized wave will not be detected.

Put another way, no matter what the point of view within hemisphere 60 the in-phase and quadrature components will be identical and will be at right angles to each other with these two vectors orthogonal and having equal magnitudes. This is characteristic of circular polarization, and from antenna 50's point of view, its polarization characteristic is circular no matter the angle of arrival of the incoming signal.

How to construct such an orientation-independent circularly polarized antenna which preserves its circular polarization 360° around the azimuth and 180° from horizon to horizon can best be explained by the manner in which antenna 50 is meant to operate.

Figure 4:
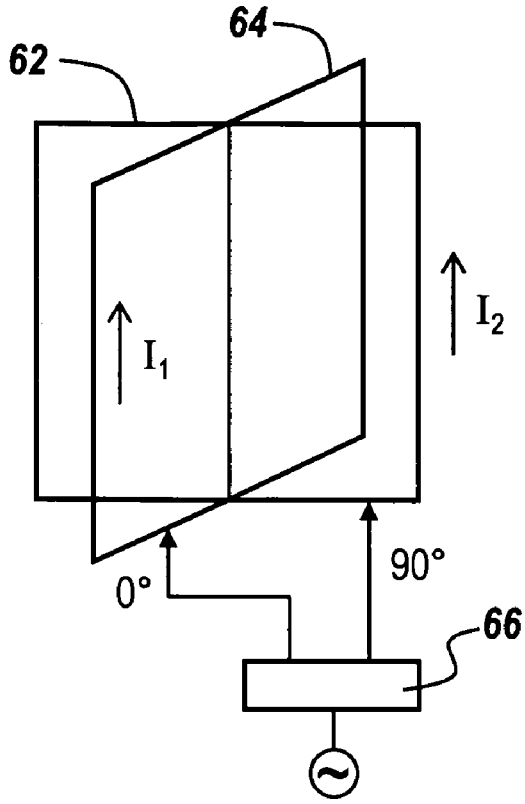
FIG. 4 is a diagrammatic illustration of crossed vertical loop antennas fed in quadrature so as to provide a circular polarization at the zenith of the antenna, but with the circular polarization degraded as one goes towards the horizontal.

Referring to FIG. 4, in order to provide a truly circularly polarized antenna, or at least when having a circular polarization response throughout a hemisphere with the antenna at its center, one utilizes crossed vertical loops 62 and 64. In one embodiment each of these loops have 4 legs and are mounted orthogonal one to the other. Assuming that the currents $I_1$ and $I_2$ are constant along the loop, for circular polarization $I_1$ and $I_2$ are in quadrature exhibiting a 90° phase difference. This is shown by the phasing circuit 66 in which currents $I_1$ and $I_2$ are 90° out of phase.

The characteristic of crossed vertical loops driven in this manner is that one has a circular polarization at the zenith and a vertical polarization at the horizon. Thus, from the zenith as one progresses to the horizon, the circular polarization degrades.

Figure 5:
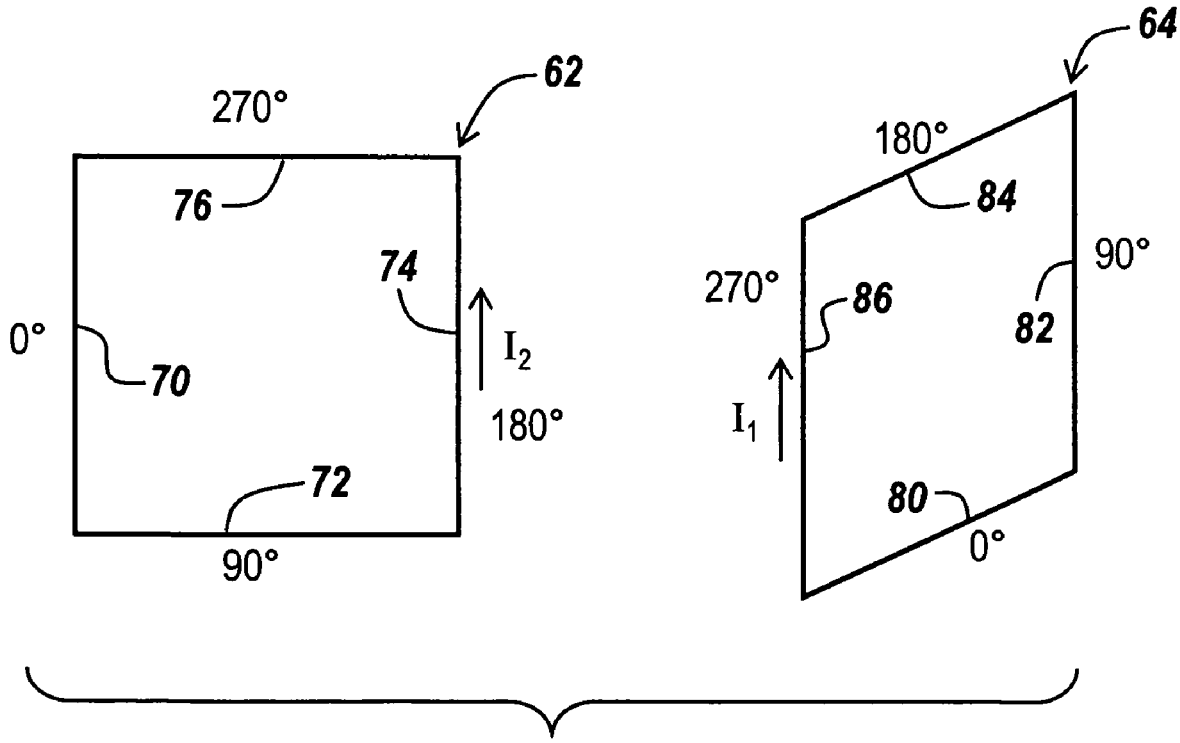
FIG. 5 is a diagrammatic illustration of the loops utilized in the crossed vertical loop configuration of FIG. 4 illustrating square loops having legs, in which the legs are excited in progressive phases starting from 0°, going through 90°, 180° and finally 270°.

While circular cross vertical loops provide circular polarization at the zenith, as shown in FIG. 5, legs 70, 72, 74 and 76 of loop 62 are excited such that the legs have a progressively stepped phasing. This means that assuming leg 70 has a 0° phase, with respect to leg 70, leg 72 will have a phase shift of 90°, leg 74 will have a phase shift of 180°, and leg 76 will have a phase shift of 270°.

Likewise for crossed loop 64, assuming leg 80 has a 0° phase, with respect to leg 80, leg 82 will be shifted by 90°, leg 84 will be shifted by a 180° phase, and leg 86 will be shifted by leg 270°.

While starting off with constant current in the vertical crossed loops, progressive leg phasing is utilized in the crossed loops because it gives a better approximation to circular polarization. Furthermore, progressively phasing the legs of the vertical loops provides circular polarization not only over the hemisphere but also below the horizon down to approximately 45 degrees. Thus, as the progressive phase excitation of the legs of the vertical loops yields a better approximation to circular polarization.

Figure 6:
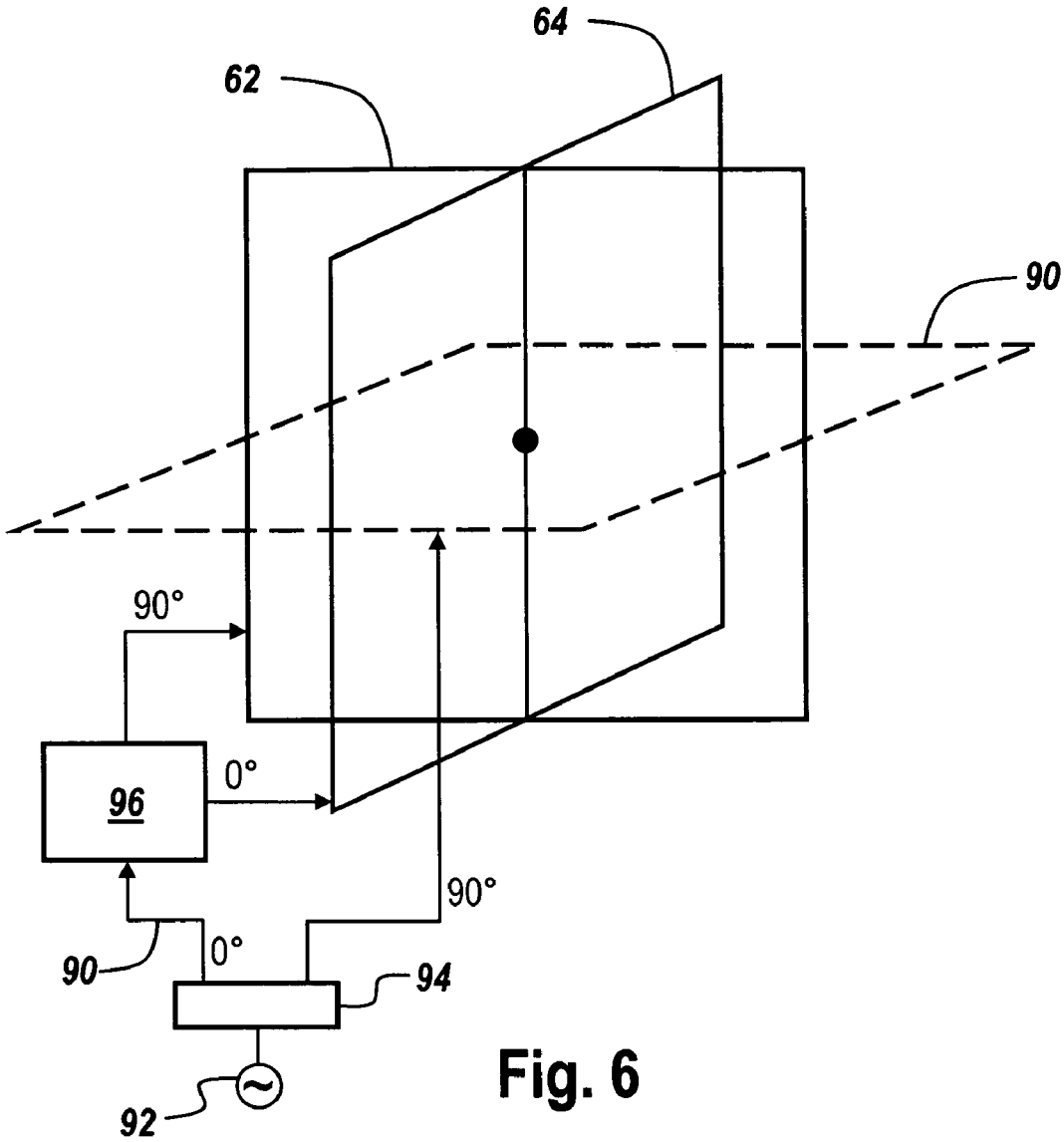
FIG. 6 is a diagrammatic illustration of the vertical crossed loops of FIG. 4 illustrating the utilization of a horizontal loop that is orthogonal to both of these loops, with the horizontal loop being fed 90° out of phase with respect to the vertical loops.
Figure 7:
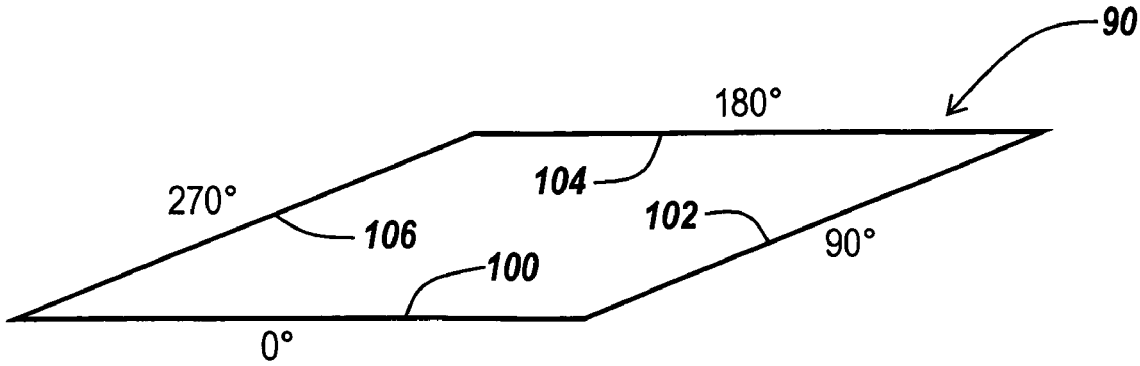
FIG. 7 is a diagrammatic illustration of the phasing of the legs of the horizontal loop of FIG. 6 indicating progressive 90° phase shifts between the legs.

Referring now to FIG. 6, assuming that one has properly excited and phased the vertical loops, horizontal loop 90 is utilized to fill in the circular polarization from the zenith to the nadir. As can be seen, horizontal loop 90 is mounted orthogonal to vertical loop 62 and 64 and in general is driven at 90° our of phase with respect to the signals applied to the vertical loops. Thus, a signal at source 92 is applied to a hybrid 94 which drives the horizontal loop 90 with a 90° phase shift with respect to a signal on line 96 that is applied to a hybrid 98. It can be seen that the hybrid passes the 0° phase shifted signal to loop 62 and phase shifts the signal to loop 64 by 90°.

As will be seen, horizontal loop 90 is provided with legs or segments 100, 102, 104 and 106 which are excited with progressive 90° phase shifts, such that if leg 100 has a 0° phase shift, leg 102 is progressively shifted by 90°, leg 104 by 180°, leg 106 by 270° with respect to leg 100.

The vertically polarized wave from the vertical crossed loops has a progressive phase as a function of azimuth. The horizontal loop must have a progressive phase that matches the progressive phase of the wave from the vertical crossed loops. Note also that the phase of the horizontal loop must be offset 90° from that of the vertical crossed loops.

A volumetric antenna which can provide for the two crossed vertical loops and the horizontal loop is implemented utilizing a cubic structure in which the cube carries four triangular shaped conductive elements on each face.

Figure 8:
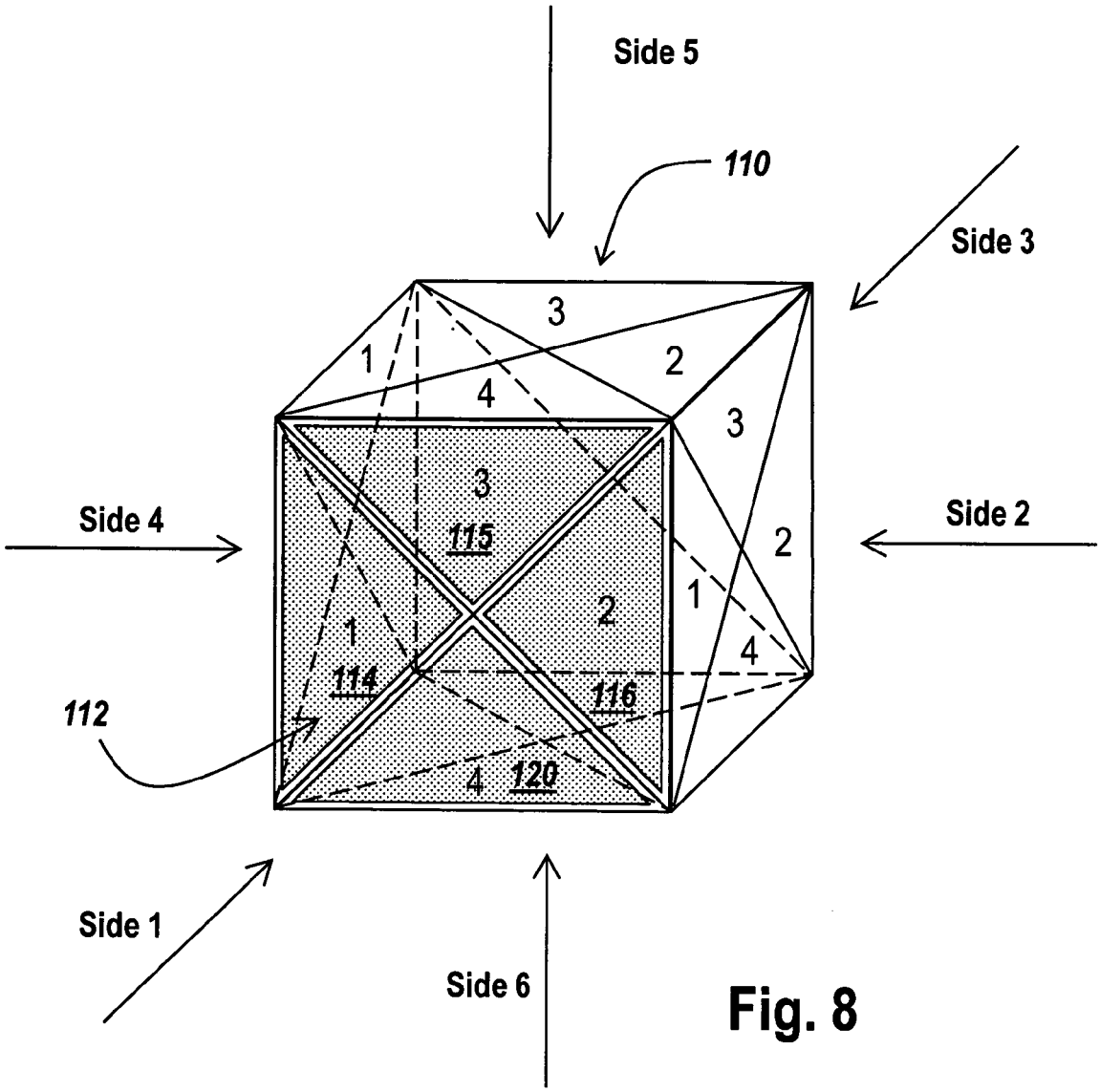
FIG. 8 is a diagrammatic illustration of the subject invention showing the triangular shaped sections on a face of the cube with the triangular shaped sections being spaced one from the other as illustrated.

As illustrated in FIG. 8, cube 110 has a side 112 on which are disposed triangular elements 114, 116, 118 and 120 respectively elements 1, 2, 3 and 4. This structure is duplicated on each of the sides of the cube, with the pairs of opposed triangular elements being phased to provide for the aforementioned three loops.

Figure 9:
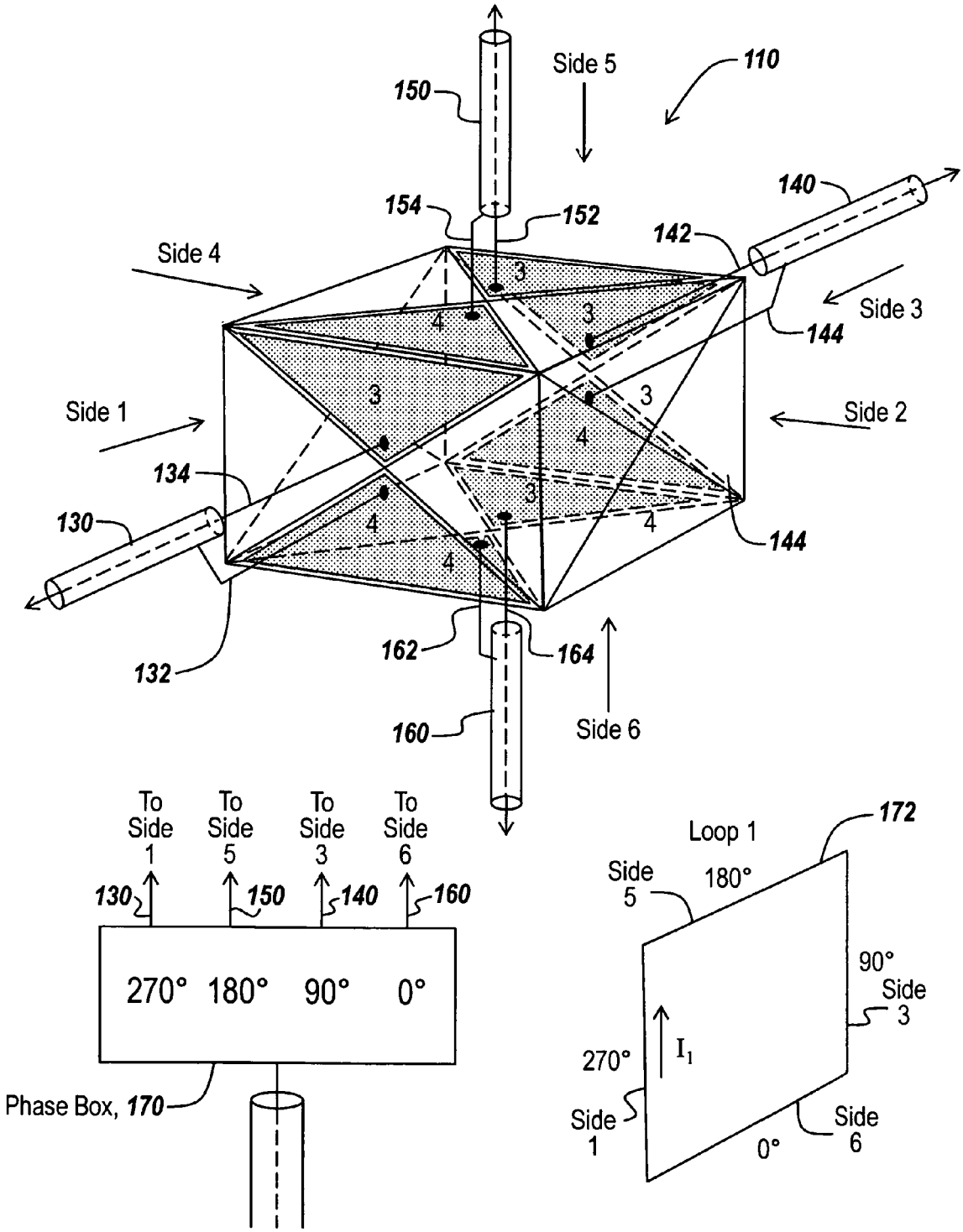
FIG. 9 is a diagrammatic illustration of the subject cubic antenna having triangular elements that are disposed on the faces of the cube, with one vertical loops being composed of opposed triangular elements on side 1, side 3, side 5 and side 6 of the cube with the triangular elements driven so as to provide one of the vertical loops and with the legs of the loop being progressively 90° phase as illustrated.

Having constructed this antenna, as illustrated in FIG. 9, various of the triangular shaped elements can be driven so as to provide vertical crossed loop 1, which is the first of the orthogonally mounted vertical loops.

In this figure, cube Sides 1, 3, 5 and 6 are driven utilizing coaxial cable having a center conductor and an outer braid attached to opposed apexes of opposed triangular elements. In this figure, as far as Side 1 is concerned, coax 130 has its outer braid 132 connected to the apex of triangular element 4, with the center conductor 134 coupled to the apex of triangular element 3. As to Side 3, coax 140 has its center conductor 142 coupled to the apex of element 3 on Side 3 and its outer braid 144 connected to the apex of triangular element 4.

Likewise for Side 5, coax 150 has its center conductor 152 connected to the apex of triangular element 3, whereas the outer braid at 154 is connected to triangular element 4. Finally, for Side 6, coax 160 has its center conductor 164 coupled to the apex of triangular element 3, whereas the outer braid 162 is coupled to the apex of triangular element 4.

Coaxes 130, 140, 150 and 160 are phased by a phasing box or module 170 to provide the indicated phasing. This corresponds not only to the creation of Loop 1 but also provides Loop 1 with the stepped phasing 0°, 90°, 180° and 270° for the legs as illustrated at 172.

Figure 10:
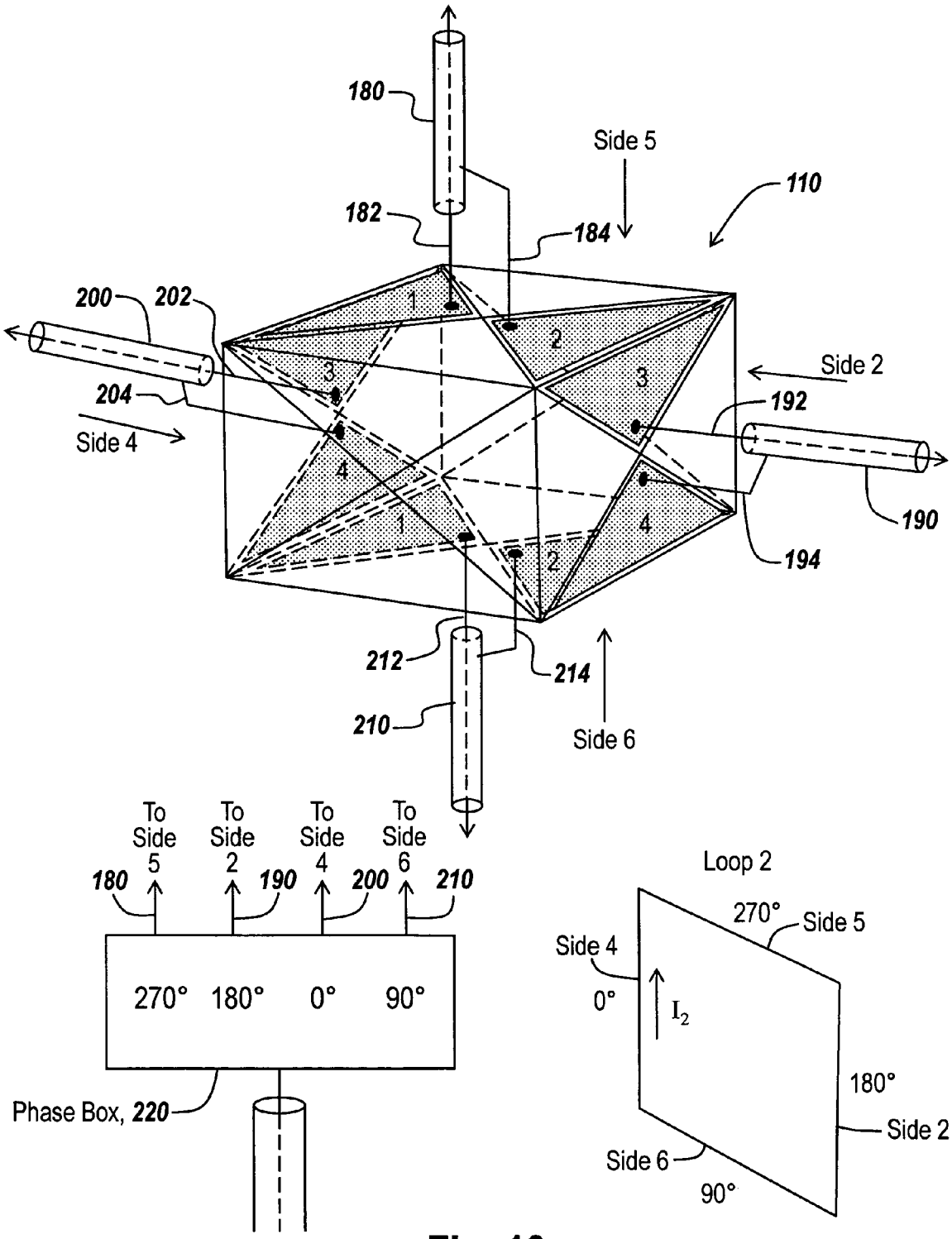
FIG. 10 is a diagrammatic illustration of the cubic antenna of FIG. 8 showing the drive of elements on side 5, side 2, side 4 and side 6 to provide the other of the vertical loops, with the phasing of these elements as illustrated and with the excitation of the legs of this second vertical loop being progressively phased.

Referring now to FIG. 10, the formation of Loop 2 has associated triangular shaped elements on Sides 5, 2, 4 and 6. Here, as to Side 5, coax 180 has its center conductor 182 coupled to element 1, whereas the outer braid 184 is coupled to element 2. As to Side 2, coax 190 as a center conductor 192 coupled to element 3 with the outer braid 194 coupled to element 4.

As to Side 4, coax 200 has its center conductor 202 coupled to triangular element 3, whereas the outer braid 204 is coupled to triangular element 4.

Finally, coax 210 has a center conductor 212 coupled to element 1, whereas the outer braid 214 is coupled to element 2.

Phasing module 220 establishes the indicated phasing on the noted coaxial lines and provides Loop 2 with the stepped phasing from 0° through 270° for the various legs thereof.

Figure 11:
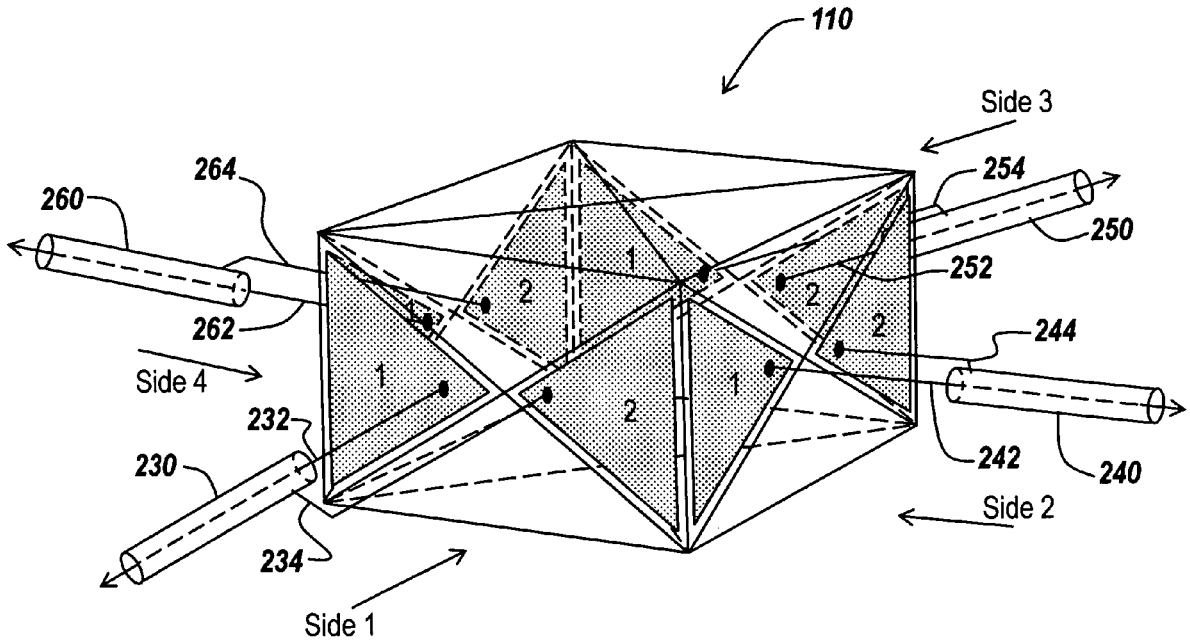
FIG. 11 is a diagrammatic illustration of the antenna of FIG. 8 that is driven to provide the horizontal loop, involving activation of horizontally disposed triangular elements on sides 1, 2, 3 and 4, with the phasing for these sides being as illustrated and with the excitation being progressively 90° phase shifted around the loop from 0°, 90° through 180° to 270°.
Figure 11:
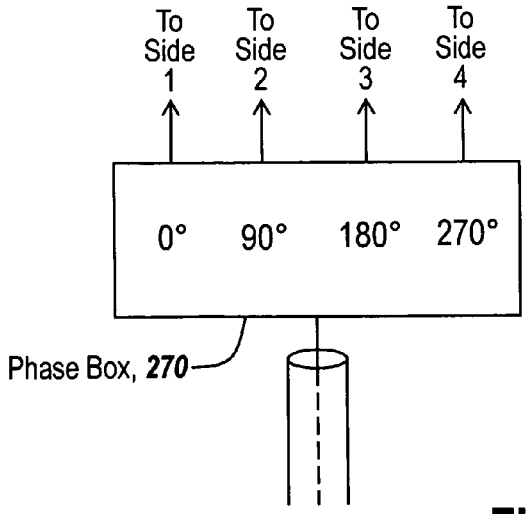
Figure 11:
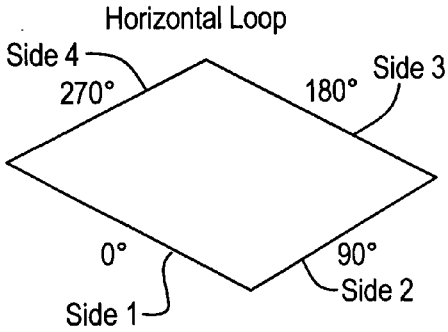

Referring now to FIG. 11, the horizontal loop is established by sections 1 and 2 on Sides 1, 2, 3 and 4 of antenna 110 with coax 230 having it center conductor 232 connected to element 1 and its outer braid 234 connected, to element 2. For Side 2, coax 240 has its center conductor 242 connected to element 1 and its outer braid 244 connected to element 2.

The same is true for Side 3 where coax 250 has its center conductor 252 connected to element 1 and its outer braid 254 connected to element 2.

Finally, coax 260 has its center conductor 262 connected to element 1, whereas its outer braid 264 is connected to element 2.

Here, phasing module 270 phases the coax lines as illustrated, with the phasing providing the stepped 90° leg phasing on the horizontal loop as illustrated.

The above phasing of the elements of the cubic antenna to provide angle independent circular polarization requires sophisticated phasing circuitry or phasing modules.

Figure 12:
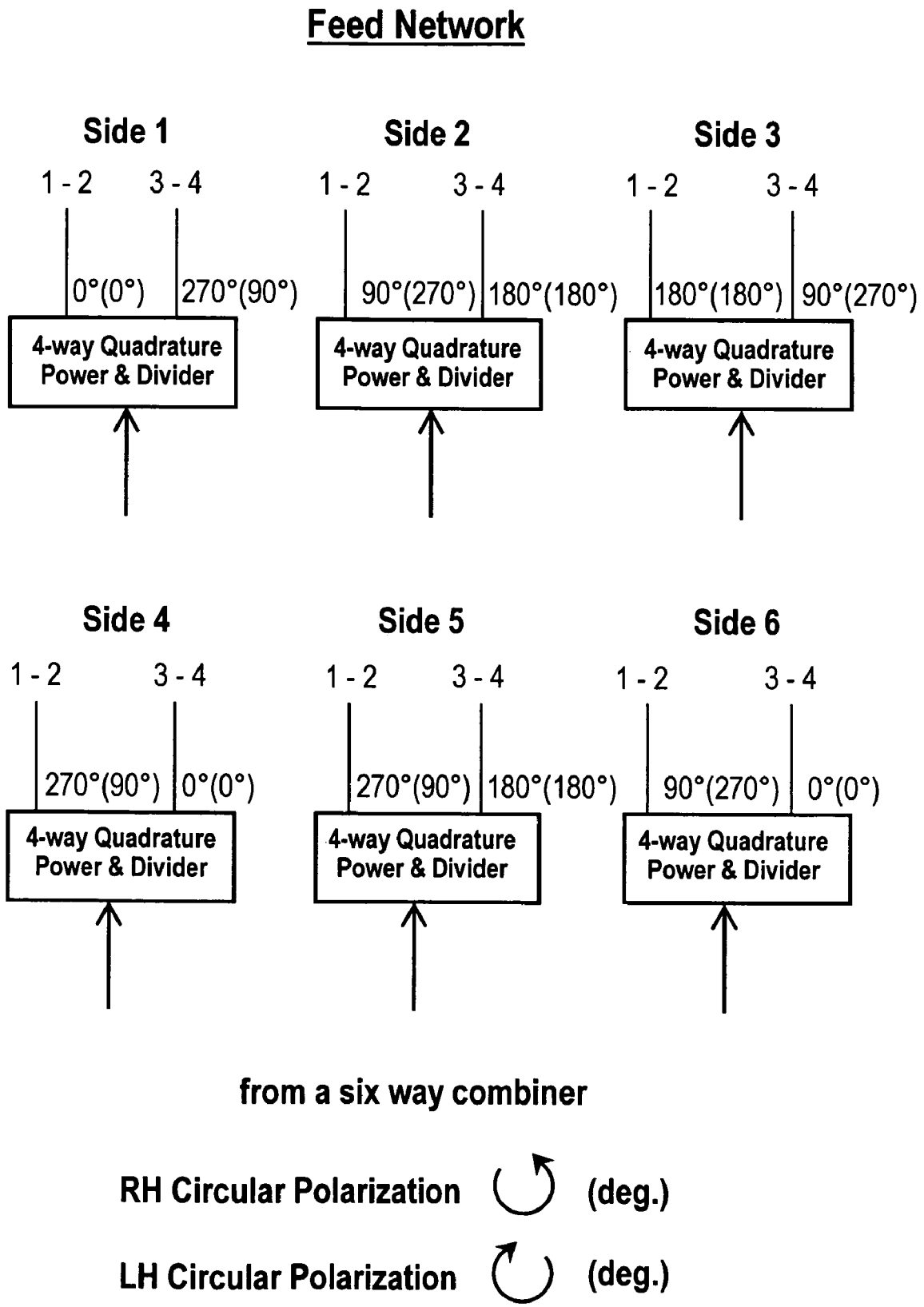
FIG. 12 is a diagrammatic illustration of the utilization of six hybrids to simultaneously drive each of the three loops with appropriate phasing such that the vertical loops are 90° out of phase, with the legs of the vertical loops being stepped in 90° increments and with the feeding of the horizontal loop, 90° out of phase with the signals to the vertical loops and also excited progressively with phase shifts from 0° through 90°, 180° and 270°.

Moreover, referring to FIG. 12, with only six standard hybrids or 4-way quadrature power dividers, one can simultaneously phase the vertical loops 90° apart, provide for the stepped leg phasing and also phase the horizontal loop 90° from the vertical loops and at the same time provide the legs of the horizontal loop with the stepped phasing. Note that for a reverse circular polarization one selects the conjugate phase shift shown in parenthesis.

It can be shown that with the hybrids of FIG. 12, one can provide the hemispheric circular polarization characteristic for the antenna and also provide for coverage below the horizon down to 45°.

Figures 13, 14:
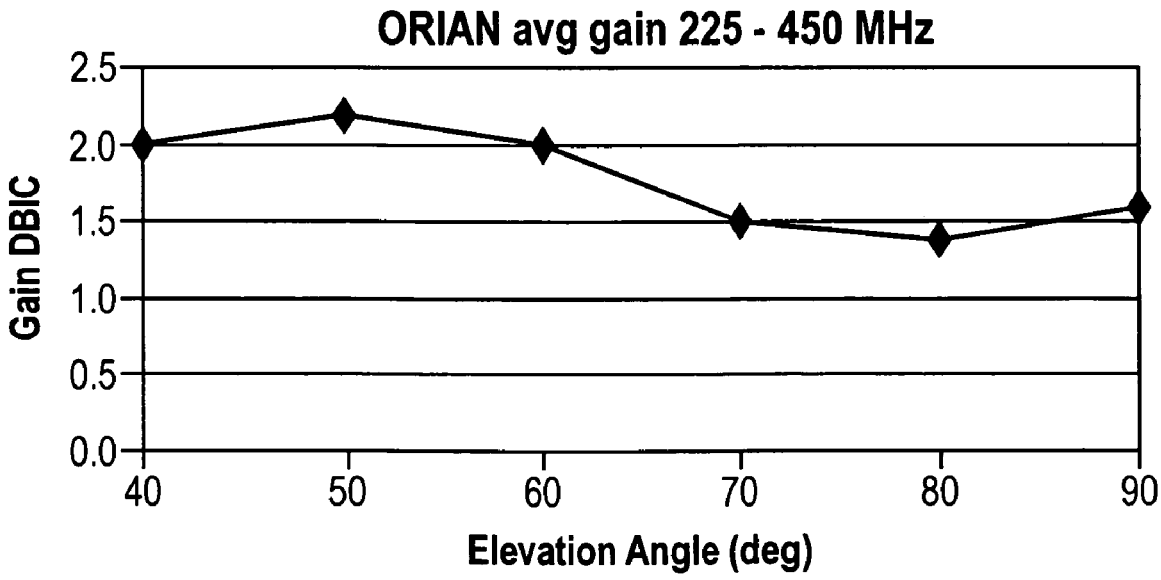
FIG. 13 is a diagrammatic illustration of the phasing between triangular elements correlated to the side of the cube.
FIG. 14 is a graph of gain versus elevation angle for the antenna of FIG. 8.

The hybrids of FIG. 11 are in accordance with the table of FIG. 13 that refers to the phasing between elements 1-2 and the elements 3-4 on the indicated sides.

Moreover, as can be seen in FIG. 14, the overall gain with respect to elevation angles is substantially constant over a wide bandwidth of 225-450 MHz, making this antenna a relatively wide bandwidth antenna.

Figure 15:
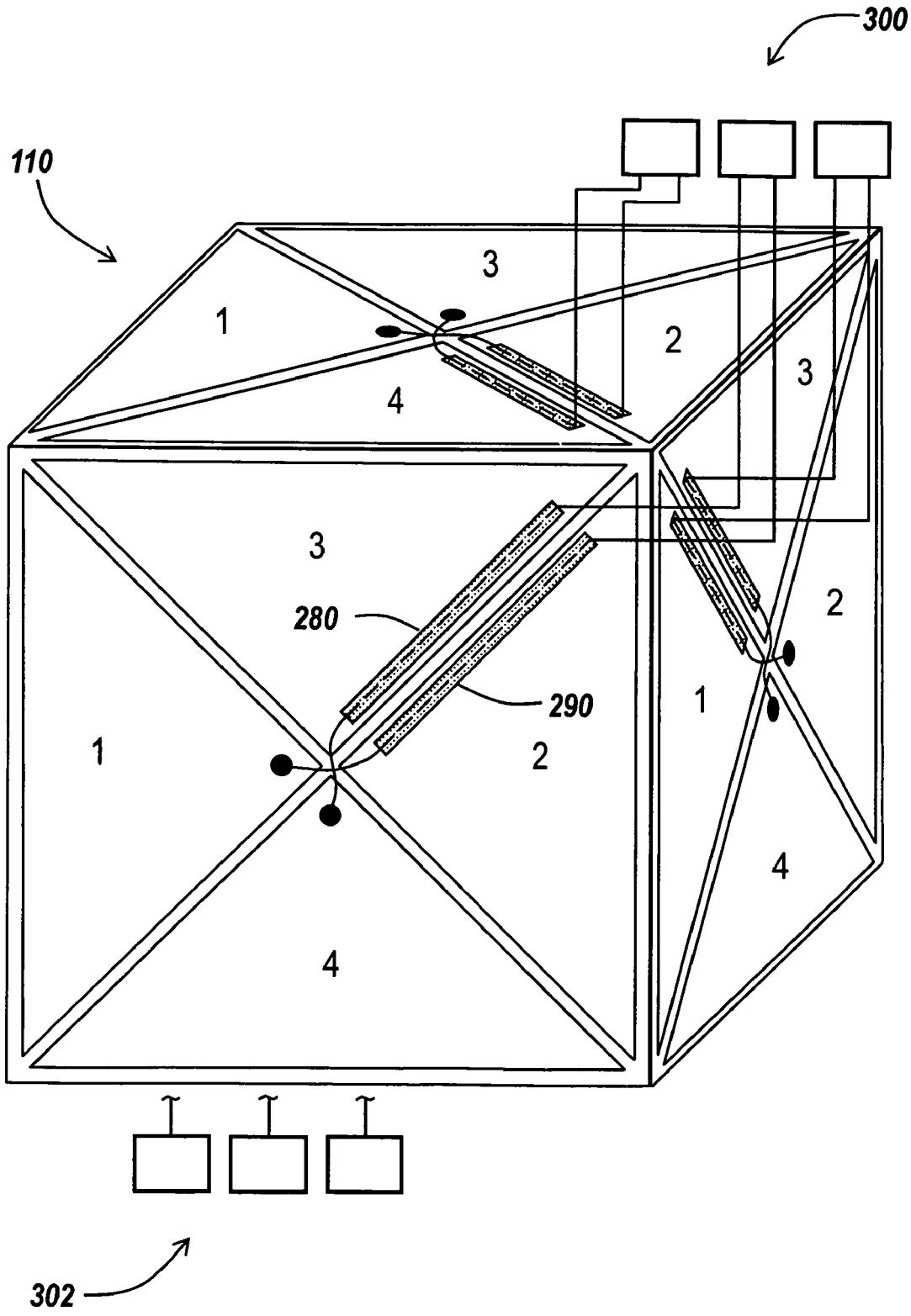
FIG. 15 is a diagrammatic illustration of the feeding of the antenna of FIG. 8 from the point of exterior to the antenna utilizing coaxial cables having their outer braids mounted to respective triangular elements and with the six hybrids of FIG. 11 driving respective triangular elements at the corner of the cube; and, FIG. 16 is a diagrammatic illustration of the use of shorts in the antenna of FIG. 8 to improve VSWR performance.

Referring now to FIG. 15, if it is not desirable to provide the hybrids within the confines of the cube, the antenna may be driven exteriorly with the hybrids attaching to respective coax feeds that emanate from a corner of the cube and run down the triangular elements, with the exterior braid bonded to the respective triangular element as illustrated. Here, antenna 110 is shown having coaxes 280 and 290 running down respective edges of triangular elements 2 and 3 with these coaxes coupled to hybrids 300.

What can be seen is that the appropriate phasing can be accomplished by externally driving half of the triangular elements from one corner of the cube as illustrated using three hybrids, with an opposed corner (not shown) driven by a second set of hybrids 302 so as to provide for the drive and phasing to produce the orthogonal oriented vertical loops and an orthogonally oriented horizontal loop to give the antenna its circular polarization characteristic.

Note that the subject antenna is right hand and left hand polarization capable. For optimal operation both modes can be simultaneously monitored to obtain the advantages of polarization diversity. In fact the two polarization modes may be used as two separate channels. The additional polarization mode is obtained, referring to FIG. 12, by utilizing a second 6-way combiner and feeding it with the unused output of ports of the six 90 degree hybrids.

It will be appreciated that the cubic geometry can be altered to a spherical configuration with the 24 triangles laid out on a sphere. The feed methodologies are the same as those of the cubic version. The sphere reduces an error present in the cube due to a deviation from ideal sinusoidal excitation. The worst case axial ratio improves from 0.8 for the cube to 0.95 for the sphere.

Increased Bandwidth Due to Lower VSWR

Figure 16:
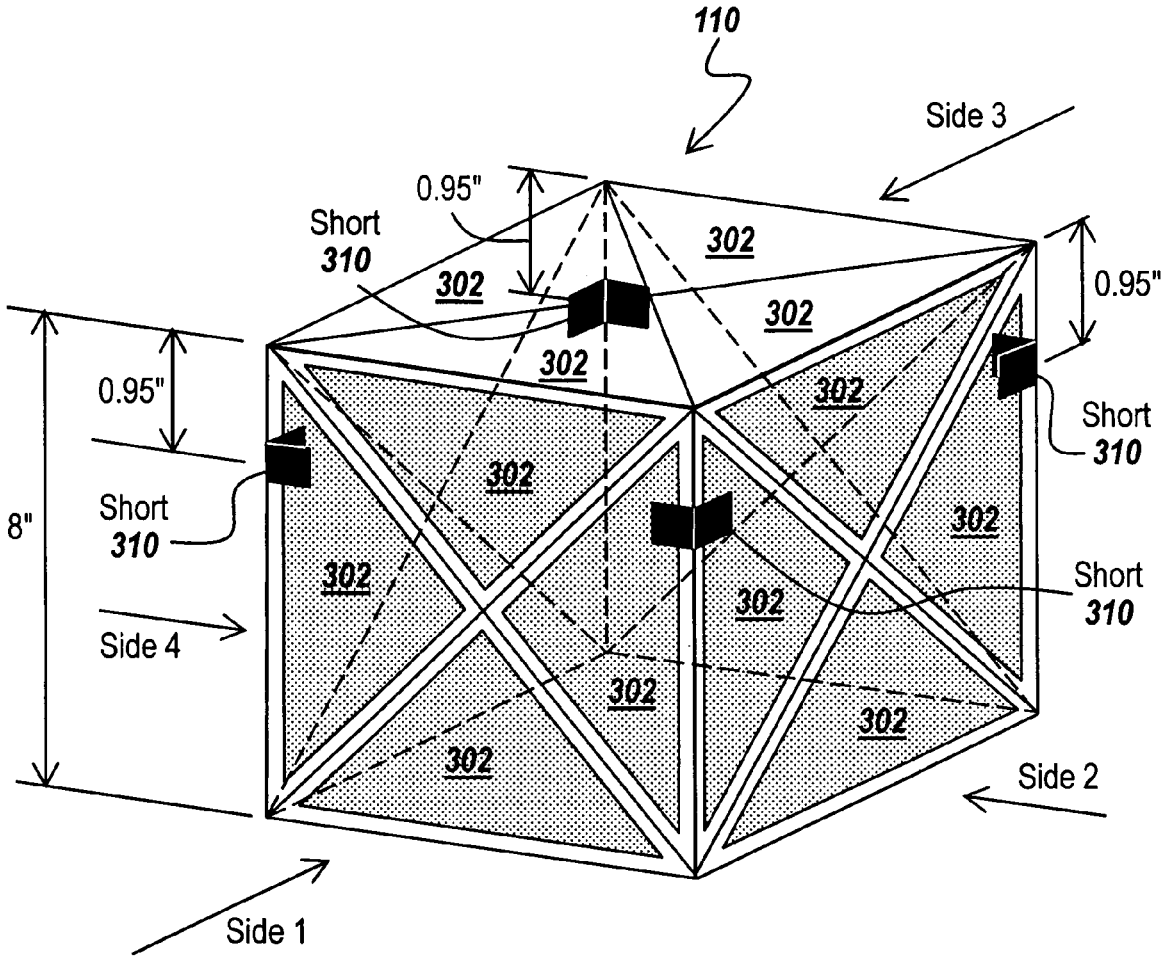

Referring now to FIG. 16, antenna 110 is provided with a number of triangular shaped elements 302 on the various six faces of the antenna. As mentioned above, at least for satellite communications purposes, it is important to have the frequency response of the antenna be, for instance, between 225 MHz and 450 MHz. In order for the antenna to properly operate, especially when coupling the antenna to a transmitter, the VSWR is required to be less than 2.5:1.

While the antenna described hereinbefore is generally satisfactory when one goes below 245 MHz, the VSWR rapidly exceeds 2.5:1. What happens at this point is that a transmitter will throttle down its output and will quickly shut off in the face of rising VSWR. Thus, in order to extend the transmitter operating range of the antenna, it is important to reduce the VSWR at these lower frequencies.

This has been accomplished in the subject invention by providing shorts between adjacent antenna elements and more particularly between the bases of triangular elements on adjacent vertical sides of a cube.

These shorts are illustrated in FIG. 16 at 310 and are generally located a short distance from the top corners of the cube.

In one embodiment, with a cube eight inches on a side, the shorts are positioned 0.95 inches from the adjacent top corner of the cube.

This offset for the short from the cube corner was arrived at empirically and provides good results for short placement within an eighth of an inch.

It is noted that the antenna cube and the offset for the shorts are scalable such that the short offset is 0.11875 with respect to the length of a side of the cube.

With the empirically-derived positioning of the shorts, the antenna exhibits less than a 2.5:1 VSWR so that the antenna can work down to 225 MHz.

In adapting the cubic antenna of FIGS. 8-15 to be more broad banded, it was necessary to provide additional synergy between the sides of the cube and more importantly between the elements thereon. It will be appreciated that the shorts provide a small amount of extra coupling between the sides of the cube, with the extra coupling being effective to reduce the VSWR.

While the exact position of the shorts with respect to the corners of the cube were derived empirically, the subject invention is not limited to the exact positioning of the shorts but is rather broad enough to encompass positioning shorts between adjacent antenna elements.

Moreover, when utilizing a spherical shape for the antenna, shorts between laterally adjacent elements on the surface of the sphere are within the scope of this invention.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A wideband orientation-independent antenna which presents a hemispherical circular polarization characteristic to incoming signals such that the signals are detected regardless of polarization and angle of arrival, comprising:

a pair of vertical loops, each loop having loop elements that make up a vertical loop, the vertical loops positioned orthogonal one to the other;

a horizontal loop make up of loop elements;

a phasing module for driving said vertical loops with a 90 degree phase shift there between and for driving said horizontal loop with signals that are offset 90 degrees from those driving said vertical loops, such that said antenna presents an orientation-independent circular polarization characteristic and hemispherical coverage; and, a short circuit used between selected loop elements to decrease the VSWR at the lower frequence in the frequency band in which the antenna is to operate.

2. The antenna of claim 1, wherein each of said loops has four legs and wherein said phasing module drives each of the legs in each loop with a phase angle of 0 degrees, 90 degrees, 180 degrees and 270 degrees.

3. The antenna of claim 1, wherein said loops include a number of elements, with said elements driven so as to achieve said circular polarization characteristic.

4. The antenna of claim 3, wherein said elements are triangular in shape to make the antenna wideband.

5. The antenna of claim 4, wherein said loops are formed by said elements arranged on the surface of a cube.

6. The antenna of claim 5, wherein each face of said cube includes four of said triangular elements having bases extending to the edge's of the cube face and having apexes pointed towards the center of the respective cube face, and wherein said shorts are provided between adjacent bases on elements located on vertical sides of the cube.

7. The antenna of claim 6, wherein said phasing module feeds pairs of said triangular elements at the opposed apexes thereof.

8. The antenna of claim 1, wherein said phasing module includes six hybrids.

9. The antenna of claim 8, wherein said hybrids drive selected pairs of triangular shaped elements on a face of said cube.

10. The antenna of claim 1, wherein said antenna is in the form of a cube having triangular shaped elements on each face of the cube and wherein said shorts are between selected triangular shaped elements on different but adjacent faces of the cube.

11. The antenna of claim 1, wherein said antenna is given a right hand circular polarization characteristic.

12. The antenna of claim 1, wherein said antenna is given a left hand circular polarization characteristic.

13. The antenna of claim 1, wherein said loops are driven such that said antenna is given both a right hand circular polarization characteristic and a left hand circular polarization characteristic available in separate channels, thereby to double the data rate associated with said antenna.

14. A method for generating an orientation-independent circular polarization antenna having an increased bandwidth, comprising the steps of:

providing crossed vertical loops having triangular shaped elements;

providing a horizontal loop having triangular shaped elements and oriented orthogonal to the crossed vertical loops;

driving said loops such that they are phased with respect to each other to provide an orientation-independent hemispherical coverage circular polarization characteristic, with the missing polarization of 0° filled in by the horizontal loop; and, shorting selected loop elements together at predetermined locations to decrease the VSWR of the antenna at the lower frequencies thereof.

* * * * *